US011016415B1

(12) United States Patent
Jang et al.

(10) Patent No.: US 11,016,415 B1
(45) Date of Patent: May 25, 2021

(54) DEVELOPMENT CARTRIDGE WITH DEVELOPER INLET FOR REFILLING DEVELOPER AND CAP SEALING DEVELOPER INLET

(71) Applicant: HEWLETT-PACKARD DEVELOPMENT COMPANY, L.P., Spring, TX (US)

(72) Inventors: Hojin Jang, Suwon-si (KR); Seil Kwon, Hwaseong-si (KR); DaeHo Kim, Seongnam-si (KR); Jong-Hyun Park, Hwaseong-si (KR); Jong-Hwa Park, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/049,557

(22) PCT Filed: Feb. 25, 2019

(86) PCT No.: PCT/US2019/019399
§ 371 (c)(1),
(2) Date: Oct. 21, 2020

(87) PCT Pub. No.: WO2020/040814
PCT Pub. Date: Feb. 27, 2020

(30) Foreign Application Priority Data

Aug. 23, 2018 (KR) ..... 10-2018-0098848

(51) Int. Cl.
*G03G 15/08* (2006.01)

(52) U.S. Cl.
CPC ..... *G03G 15/0886* (2013.01); *G03G 15/0867* (2013.01); *G03G 15/0893* (2013.01); *G03G 2215/0636* (2013.01)

(58) Field of Classification Search
CPC ..... G03G 15/0844; G03G 15/0867; G03G 15/0886; G03G 15/0891; G03G 15/0893; G03G 2215/0636
See application file for complete search history.

(56) References Cited

U.S. PATENT DOCUMENTS 8,942,600 B2 1/2015 Nakaue et al.
2014/0126934 A1 5/2014 Mushika et al.
(Continued)

FOREIGN PATENT DOCUMENTS

JP 2007072347 3/2007
JP 2009092874 4/2009
(Continued)

*Primary Examiner* — Sophia S Chen
(74) *Attorney, Agent, or Firm* — Staas & Halsey LLP

(57) ABSTRACT

A development cartridge includes a developer housing to receive a developer. The developer housing includes a developing chamber to have a developing roller in the developing chamber and extending in a longitudinal direction of the developing roller, an agitating chamber located parallel to the developing chamber, and a partition wall to separate the developing chamber from the agitating chamber, the partition wall having a first communication hole and a second communication hole respectively formed at both end portions of the partition wall in the longitudinal direction, through which the developing chamber and the agitating chamber are to communicate through. A developer inlet, through which the developer is injectable into the developer housing, for the developer housing to receive the developer, is formed in the developer housing at a position corresponding to the first communication hole or the second communication hole. The developer inlet is closeable with a cap.

15 Claims, 9 Drawing Sheets

(56) References Cited

U.S. PATENT DOCUMENTS

| | | | | |
|---|---|---|---|---|
| 2016/0018783 | A1 | 1/2016 | Fukamachi | |
| 2016/0085181 | A1* | 3/2016 | Sakamaki | G03G 15/0891 399/257 |
| 2017/0115606 | A1* | 4/2017 | Sakamaki | G03G 15/0893 |
| 2017/0248868 | A1* | 8/2017 | Iwata | |
| 2017/0315474 | A1* | 11/2017 | Kashimoto | G03G 15/0891 |
| 2019/0286013 | A1* | 9/2019 | Saito | G03G 15/0893 |

FOREIGN PATENT DOCUMENTS

| | | |
|---|---|---|
| JP | 2009300584 | 12/2009 |
| JP | 2013025059 | 2/2013 |
| JP | 2015087671 | 5/2015 |

* cited by examiner

DEVELOPMENT CARTRIDGE WITH DEVELOPER INLET FOR REFILLING DEVELOPER AND CAP SEALING DEVELOPER INLET

CROSS REFERENCE TO RELATED APPLICATIONS

This application is filed under 35 U.S.C. § 371 as a National Stage of PCT International Application No. PCT/US2019/019399, filed on Feb. 25, 2019, in the U.S. Patent and Trademark Office, which claims the priority benefit of Korean Patent Application No. 10-2018-0098848, filed on Aug. 23, 2018, in the Korean Intellectual Property Office. The disclosures of PCT International Application No. PCT/US2019/019399 and Korean Patent Application No. 10-2018-0098848 are incorporated by reference herein in their entireties.

BACKGROUND

A printer using an electrophotographic method forms a visible toner image on a photoconductor by supplying toner to an electrostatic latent image formed on the photoconductor, transfers the toner image to a print medium, fixes the transferred toner image on the print medium, and thereby, prints an image on the print medium. A developing unit contains the toner therein, and supplies the toner to the electrostatic latent image formed on the photoconductor and forms the visible toner image on the photoconductor.

Development methods are classified into one-component development methods using only toner as a developer and two-component development methods using toner and a carrier as a developer. A developing unit supplies a developer to an electrostatic latent image formed on a photoconductor and develops the electrostatic latent image into a visible toner image. When the developing unit that is a cartridge reaches its end of life, the developing unit may be replaced along with or separately from the photoconductor. In this case, before the developing unit is inserted into a printer body, a cover of the developing unit may be opened and the developer may be filled into the developing unit.

DETAILED DESCRIPTION

Figure 1:
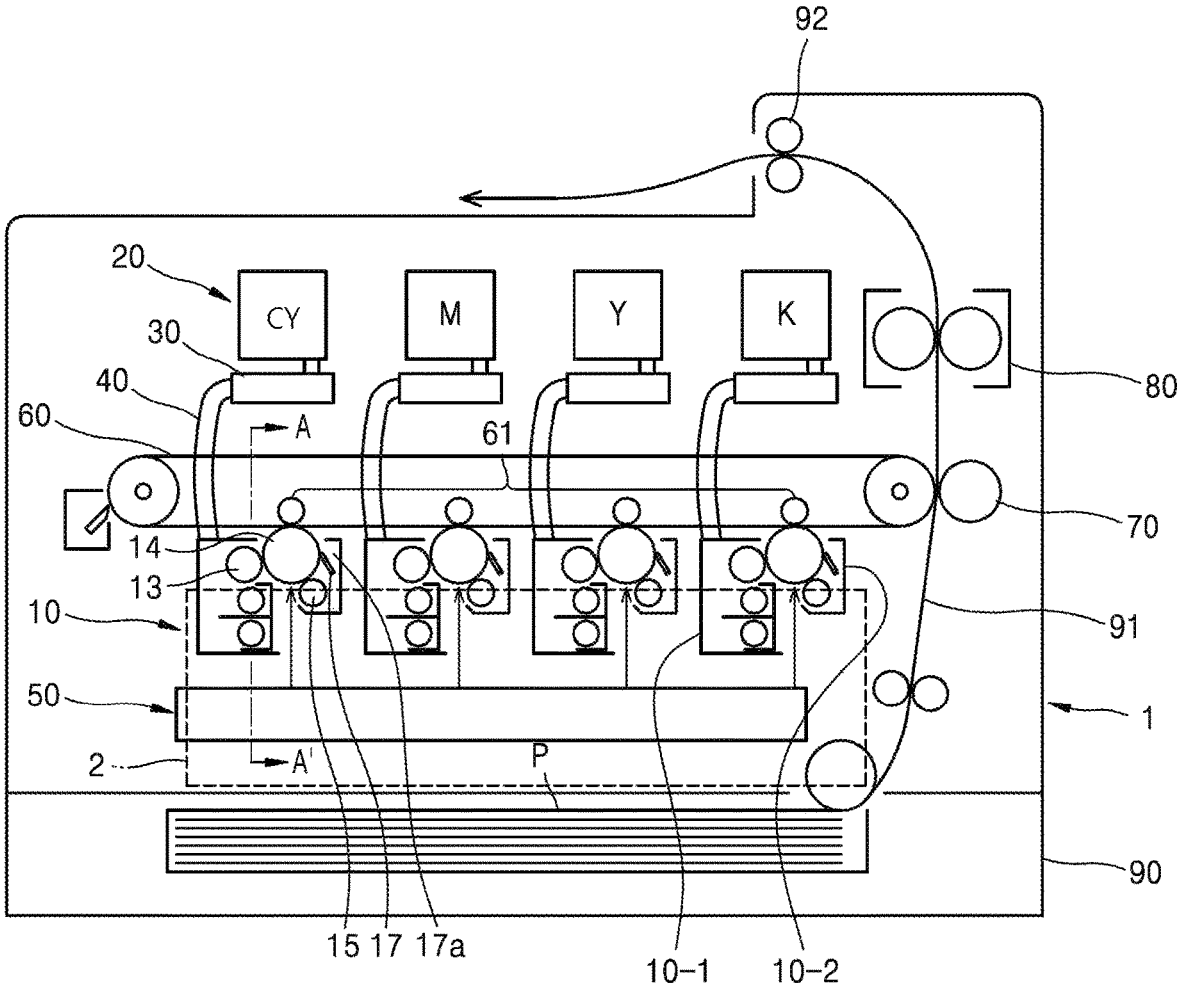
FIG. 1 is a view illustrating a configuration of a printer using an electrophotographic method according to an example.

FIG. 1 is a view illustrating a configuration of a printer using an electrophotographic method according to an example. The printer of the present example prints a color image by using an electrophotographic method. The printer of the present example is a color printer. Referring to FIG. 1, the printer may include a plurality of developing units 10, an exposure unit 50, a transfer unit, and a fusing unit 80. The printer may further include a plurality of developer cartridges 20 in which developers are contained. The plurality of developer cartridges 20 are respectively connected to the plurality of developing units 10, and the developers contained in the plurality of developer cartridges 20 are supplied to the plurality of developing units 10. The plurality of developer cartridges 20 and the plurality of developing units 10 may be attached to/detached from a main body 1, and may be individually replaced.

The plurality of developing units 10 may include a plurality of developing units for forming cyan (CY), magenta (M), yellow (Y), and black (K) toner images. Also, the plurality of developer cartridges 20 may include a plurality of developer cartridges 20 for forming the CY, M, Y, and K images in which CY, M, Y, and K developers to be supplied to the plurality of developing units 10 for CY, M, Y, and K are respectively contained. However, the scope of the present disclosure is not limited thereto, and the developer cartridges 20 and the developing units 10 for containing other color developers such as light magenta and white developers and developing other color images may be further provided. The following will be described on the assumption that the printer includes the plurality of developing units 10 and the plurality of developer cartridges 20 where reference letters CY, M, Y, and K respectively denote elements for developing CY, M, Y, and K images unless specified otherwise.

Each of the developing units 10 may include a photosensitive drum 14 on a surface of which an electrostatic latent image is formed, and a developing roller 13 for supplying a developer to the electrostatic latent image and developing the electrostatic latent image into a visible toner image. The photosensitive drum 14 that is a photoconductor on a surface of which the electrostatic latent image is formed may include a conductive metal pipe and a photosensitive layer formed on an outer circumferential surface of the conductive metal pipe. A charging roller 15 is a charger for charging a surface of the photosensitive drum 14 to a uniform surface potential. A charging brush or a corona charger, instead of the charging roller 15, may be used.

Although not shown in FIG. 1, the developing unit 10 may further include a charging roller cleaner for removing a foreign material such as dust or a developer attached to the charging roller 15, a cleaning member 17 for removing a developer remaining on a surface of the photosensitive drum 14 after an intermediate transfer process that is described below, and a regulating member for regulating the amount of a developer supplied to a development area where the photosensitive drum 14 and the developing roller 13 face each other. A waste developer is received in a waste developer receiver 17*a*. The cleaning member 17 may be, for example, a cleaning blade that contacts a surface of the photosensitive drum 14 and scrapes a developer. Although not shown in FIG. 1, the cleaning member 17 may be a cleaning brush that contacts a surface of the photosensitive drum 14 while rotating and scrapes a developer. The waste developer received in the waste developer receiver 17*a* may be transported to and received in a waste developer container 2 by a transport unit (not shown).

When a one-component development method is used, toner may be contained as a developer in the developer cartridge 20. When a two-component development method is used, toner, or toner and a carrier may be contained as a developer in the developer cartridge 20. For example, when a two-component trickle development method that is a two-component development method and involves discharging a surplus developer from the developing unit 10 is used, toner and a carrier may be contained in the developer cartridge 20. The following will be described on the assumption that a two-component development method is used.

The developing unit 10 may be divided into a development cartridge 10-1 including the developing roller 13 and a photoconductor cartridge 10-2 including the photosensitive drum 14. The development cartridge 10-1 and the photoconductor cartridge 10-2 may be individually replaced. The developing unit 10 may be an integrated developing unit in which the development cartridge 10-1 and the photoconductor cartridge 10-2 are integrally formed, and the integrated developing unit is referred to as a development cartridge.

A developer contained in the developer cartridge 20 is supplied to the development cartridge 10-1. The developing roller 13 is spaced apart from the photosensitive drum 14. An interval between an outer circumferential surface of the developing roller 13 and an outer circumferential surface of the photosensitive drum 14 may be, for example, tens of to hundreds of microns. The developing roller 13 may be a magnetic roller. Also, the developing roller 13 may include a rotating developing sleeve and a magnet located in the rotating developing sleeve. Toner and a magnetic carrier are mixed with each other in the development cartridge 10-1, and the toner is attached to a surface of the magnetic carrier. The magnetic carrier is attached to a surface of the developing roller 13 and is transported to a development area where the photosensitive drum 14 and the developing roller 13 face each other. A regulating member 16 (see FIG. 3) regulates the amount of a developer transported to the development area. Only toner is supplied to the photosensitive drum 14 due to a development bias voltage applied between the developing roller 13 and the photosensitive drum 14 and an electrostatic latent image formed on a surface of the photosensitive drum 14 is developed into a visible toner image.

When a trickle development method is used, a surplus developer is discharged to the outside of the development cartridge 10-1 in order to maintain the amount of a developer in the development cartridge 10-1 at a constant level. The surplus developer discharged to the outside of the development cartridge 10-1 may be received in, for example, the waste developer container 2.

The exposure unit 50 emits light modulated to correspond to image information to the photosensitive drum 14 and forms an electrostatic latent image on the photosensitive drum 14. A laser scanning unit (LSU) using a laser diode as a light source or a light-emitting diode (LED) exposure unit using an LED as a light source may be used as the exposure unit 50.

The transfer unit transfers a toner image formed on the photosensitive drum 14 to a print medium P. In the present example, a transfer unit using an intermediate transfer method is used. For example, the transfer unit may include an intermediate transfer belt 60, an intermediate transfer roller 61, and a transfer roller 70.

The intermediate transfer belt 60 temporarily receives toner images developed on the photosensitive drums 14 of the plurality of developing units 10 for CY, M, Y, and K. A plurality of the intermediate transfer rollers 61 are located to face the photosensitive drums 14 of the plurality of developing units 10 for CY, M, Y, and K with the intermediate transfer belt 60 therebetween. An intermediate transfer bias voltage for intermediate-transferring the toner images developed on the photosensitive drums 14 to the intermediate transfer belt 60 is applied to the plurality of intermediate transfer rollers 61. A coroner transfer unit or a transfer unit using a pin scorotron method, instead of the intermediate transfer roller 61, may be used.

The transfer roller 70 faces the intermediate transfer belt 60. A transfer bias voltage for transferring the toner images transferred to the intermediate transfer belt 60 to the print medium P is applied to the transfer roller 70.

The fusing unit 80 fixes the toner images transferred to the print medium P onto the print medium P by applying heat and/or pressure to the toner images. The fusing unit 80 is not limited to a type shown in FIG. 1.

In this structure, the exposure unit 50 forms electrostatic latent images on the photosensitive drums 14 by scanning a plurality of light beams modulated to correspond to color image information to the photosensitive drums 14 of the plurality of developing units 10 for CY, M, Y, and K. The electrostatic latent images of the photosensitive drums 14 of the plurality of developing units 10 for CY, M, Y, and K are developed into visible toner images by using C, M, Y, and K developers supplied to the plurality of developing units 10 for CY, M, Y, and K from the plurality of developer cartridges 20 for CY, M, Y, and K. The developed toner images are sequentially transferred to the intermediate transfer belt 60 and a color toner image is formed on the intermediate transfer belt 60. The print medium P loaded on a feed unit 90 is fed along a feed path 91 between the transfer roller 70 and the intermediate transfer belt 60. The color toner image intermediate-transferred to the intermediate transfer belt 60 is transferred to the print medium P due to a transfer bias voltage applied to the transfer roller 70. When the print medium P passes through the fusing unit 80, the color toner image is fixed to the print medium P due to heat and pressure. When the color toner image is completely fixed to the print medium P, the print medium P is discharged by a discharge roller 92.

A developer contained in the developer cartridge 20 is supplied to the development cartridge 10-1. When the developer contained in the developer cartridge 20 is used up, the developer cartridge 20 may be replaced with a new developer cartridge 20, and a new developer may be filled in the developer cartridge 20.

The printer may further include a developer supply unit 30. The developer supply unit 30 receives a developer from the developer cartridge 20 and supplies the developer to the development cartridge 10-1. The developer supply unit 30 is connected to the development cartridge 10-1 by a supply pipe 40. Although not shown in FIG. 1, the developer supply unit 30 may be omitted, and the supply pipe 40 may directly connect the developer cartridge 20 and the development cartridge 10-1.

Figure 2:
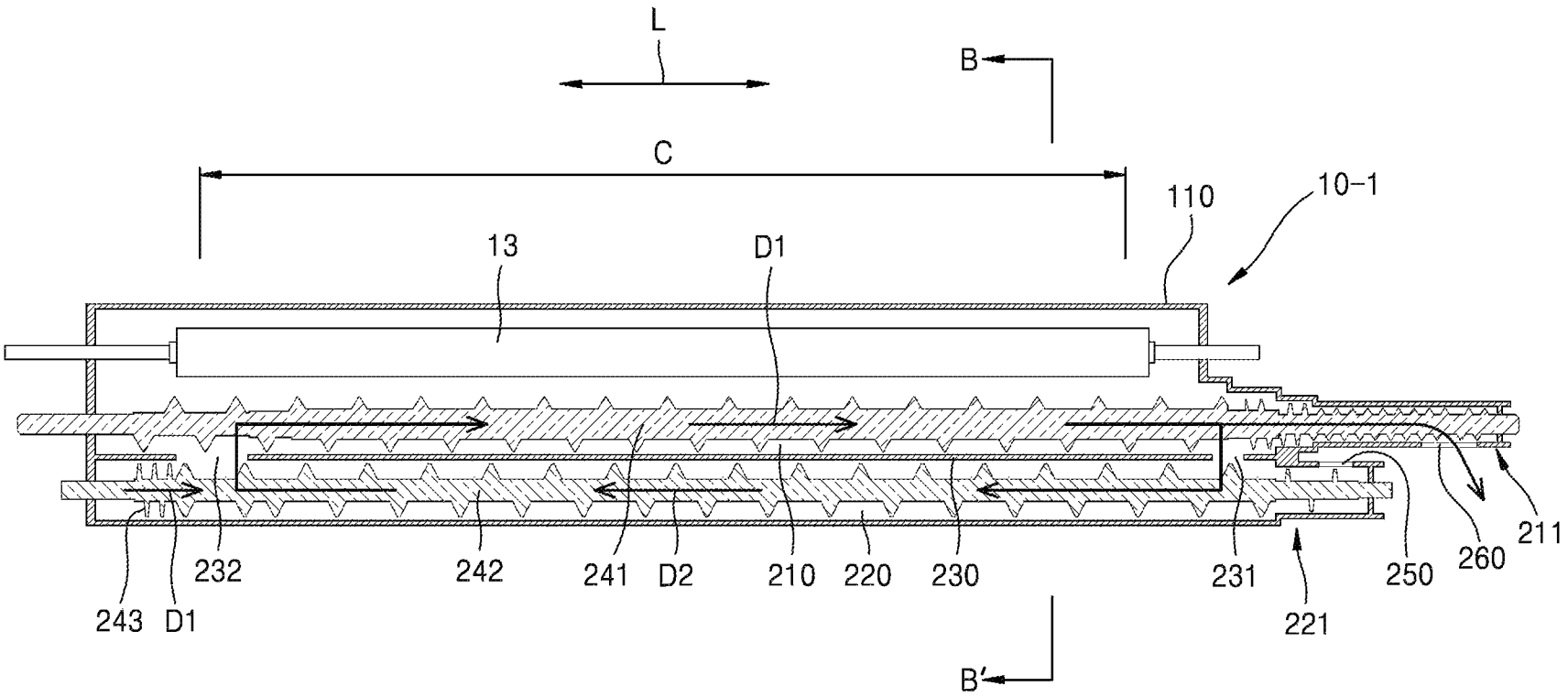
FIG. 2 is a cross-sectional view taken along a line A-A' of a development cartridge of FIG. 1.
Figure 3:
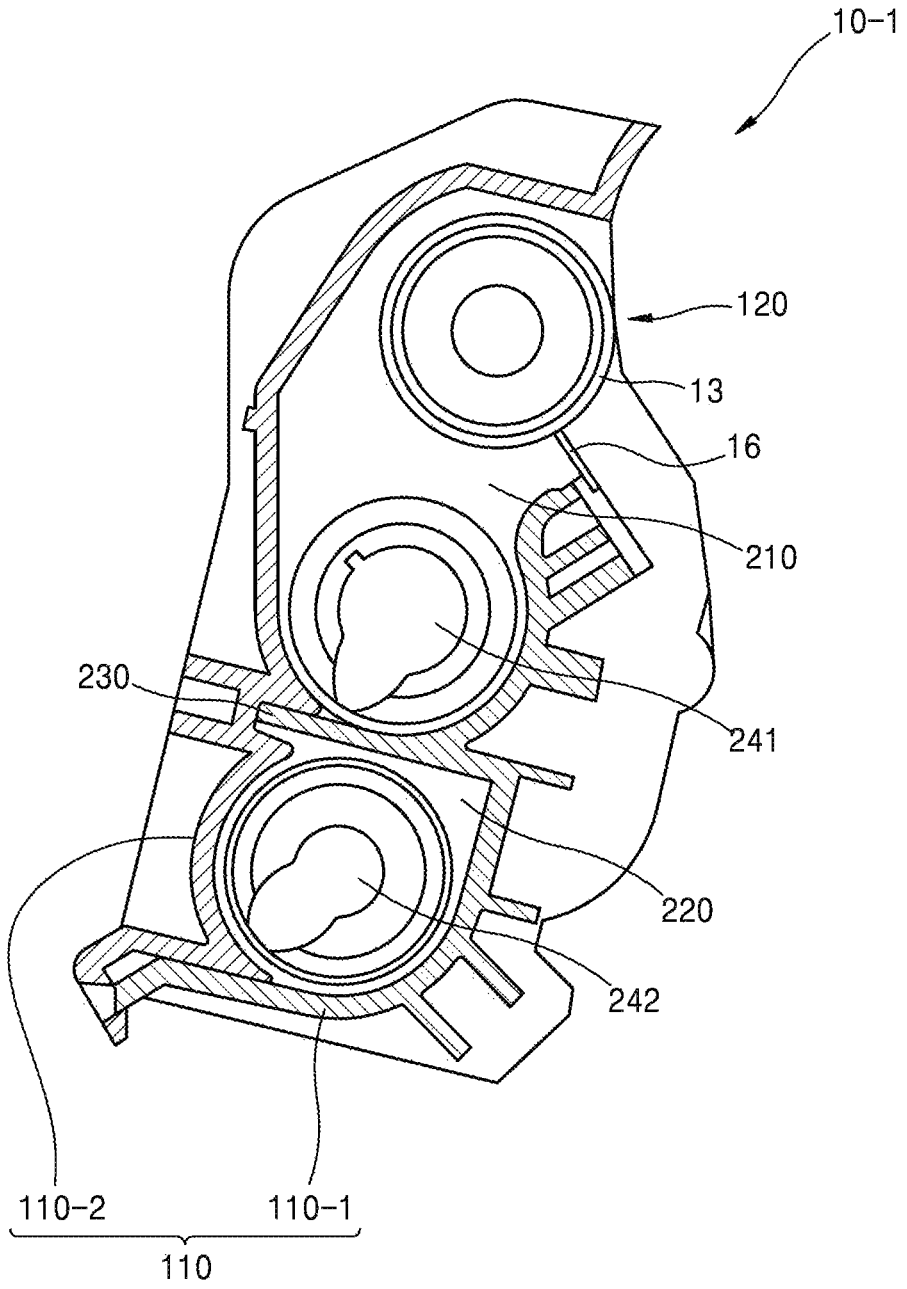
FIG. 3 is a cross-sectional view taken along a line B-B' of FIG. 2.

FIG. 2 is a cross-sectional view taken along line A-A' of the development cartridge 10-1 of FIG. 1. FIG. 3 is a cross-sectional view taken along line B-B' of FIG. 2. Referring to FIGS. 2 and 3, the development cartridge 10-1 includes a developer housing 110, and the developing roller 13 that is rotatably supported on the developer housing 110. A developer is contained in the developer housing 110. The developer may be supplied from the developer cartridge 20 in order to maintain the amount of the developer in the developer housing 110 at a constant level.

The developer housing 110 may include a developing chamber 210 allowing the developing roller 13 to be provided therein and extending in a longitudinal direction L of the developing roller 13, an agitating chamber 220 located parallel to the developing chamber 210, and a partition wall 230 configured to separate the developing chamber 210 from the agitating chamber 220 and including first and second communication holes 231 and 232 that are formed at both end portions of the partition wall 230 in the longitudinal direction L and cause the developing chamber 210 and the agitating chamber 220 to communicate with each other.

An opening 120 that is open to the photosensitive drum 14 is formed in the developing chamber 210. The developing roller 13 is provided in the developing chamber 210. A portion of the developing roller 13 is exposed to the outside of the developing chamber 210 through the opening 120, and the exposed portion of the developing roller 13 faces the photosensitive drum 14. The developing roller 13 supplies toner received in the developing chamber 210 to an electrostatic latent image formed on the photosensitive drum 14 through the opening 120 and develops the electrostatic latent image into a toner image. The agitating chamber 220 is separated from the developing chamber 210 by the partition wall 230.

First and second conveying members 241 and 242 may be respectively provided in the developing chamber 210 and the agitating chamber 220. The first and second conveying members 241 and 242 agitate the toner and a carrier by transporting the developer in the developing chamber 210 and the agitating chamber 220 in the longitudinal direction L of the developing roller 13. Each of the first and second conveying members 241 and 242 may be, for example, an auger with a spiral blade. The first and second conveying members 241 and 242 transport the developer in opposite directions. For example, the first and second conveying members 241 and 242 respectively transport the developer in first and second directions D1 and D2. The first and second communication holes 231 and 232 are respectively formed at both end portions of the partition wall 230 in the longitudinal direction L so that the developing chamber 210 and the agitating chamber 220 communicate with each other.

The developer in the developing chamber 210 is transported by the first conveying member 241 in the first direction D1. The developer is transported from the developing chamber 210 to the agitating chamber 220 through the first communication hole 231 formed at an end portion of the partition wall 230 in the first direction D1. The developer in the agitating chamber 220 is transported by the second conveying member 242 in the second direction D2. The second communication hole 232 is formed at an end portion of the partition wall 230 in the second direction D2. A reverse spiral blade 243 for transporting the developer in the first direction D1 is provided on a portion of the second conveying member 242 in the second direction D2 close to the second communication hole 232. The developer transported in the agitating chamber 220 in the second direction D2 stagnates around the second communication hole 232. When pressure applied to the developer around the second communication hole 232 is increased, the developer is transported from the agitating chamber 220 to the developing chamber 210 through the second communication hole 232. In this structure, the developer circulates along a circulation path formed in an order of the developing chamber 210, the first communication hole 231, the agitating chamber 220, the second communication hole 232, and the developing chamber 210. Part of the developer transported in the developing chamber 210 in the first direction D1 is supplied to the photosensitive drum 14 by the developing roller 13.

The development cartridge 10-1 of the present example includes a developer supply hole 250. The developer is supplied into the development cartridge 10-1, that is, the developer housing 110, from the developer cartridge 20 through the developer supply hole 250. The developer supply hole 250 may be formed outside an effective image area C of the developing roller 13. The effective image area C refers to a portion of the developing roller 13 in the longitudinal direction L that is effectively used to form an image. A length of the effective image area C may be slightly greater than a width of the print medium P having a maximum available size. The effective image area C may be located between the first communication hole 231 and the second communication hole 232. The developer supply hole 250 may be formed outside the first communication hole 231 and the second communication hole 232.

In an example, the developer supply hole 250 may be formed at an end portion of the agitating chamber 220 close to the first communication hole 231. The development cartridge 10-1 may include a supply portion 221 extending from the agitating chamber 220 beyond the first communication hole 231 to the outside of the effective image area C in the first direction D1. The developer supply hole 250 may be formed in the supply portion 221. The second conveying member 242 may extend into the supply portion 221. The developer supplied to the agitating chamber 220 through the developer supply hole 250 is transported by the second conveying member 242 in the second direction D2.

Although not shown in FIG. 2, the developer supply hole 250 may also be formed at an end portion of the agitating chamber 220 close to the second communication hole 232. In this case, the supply portion 221 may extend from the agitating chamber 220 beyond the second communication hole 232 in the second direction D2, and the developer supply hole 250 may be formed in the supply portion 221. A structure, e.g., a reverse spiral blade, for transporting the developer in the first direction D1 may be provided on a portion of the second conveying member 242 corresponding to the supply portion 221. The developer supplied to the agitating chamber 220 through the developer supply hole 250 may be transported in the first direction D1 by the reverse spiral blade and then may be transported to the developing chamber 210 through the second communication hole 232.

When a trickle development method is used, a developer outlet 260 may be formed in the developer housing 110. A surplus developer in the developing chamber 210 and the agitating chamber 220 is discharged through the developer outlet 260 to the outside of the development cartridge 10-1. The discharged surplus developer may be received in the waste developer container 2. The developer outlet 260 is formed outside the effective image area C. The developer outlet 260 may be formed outside the first communication hole 231 and the second communication hole 232.

In an example, the developer outlet 260 may be formed at an end portion of the developing chamber 210 close to the first communication hole 231. The development cartridge 10-1 may include a discharge portion 211 extending from the developing chamber 210 to the outside of the effective image area C in the first direction D1. The developer outlet 260 may be formed in the discharge portion 211. The first conveying member 241 may extend into the discharge portion 211. The surplus developer is transported by the first conveying member 241 and is discharged to the outside of the development cartridge 10-1 through the developer outlet 260.

Although the discharge portion 211 and the supply portion 221 respectively extend from the developing chamber 210 and the agitating chamber 220 in FIG. 2, the discharge portion 211 and the supply portion 221 may respectively extend from the agitating chamber 220 and the developing chamber 210.

The development cartridge 10-1 may be provided to a user in a state where the developer is filled in the development cartridge 10-1. In order to prevent the developer from leaking to the outside of the development cartridge 10-1 due to an impact such as vibration or drop during a distribution process, a developer leakage preventing film or a developer leakage preventing tape are attached to the development cartridge 10-1. The developer leakage preventing film and the developer leakage preventing tape have to be removed before the development cartridge 10-1 is inserted into the printer. When a two-component development method is used, since the developing roller 13 and the regulating member 16 are spaced apart from each other, it is possible for the developer to leak to the outside through a space between the developing roller 13 and the regulating member 16 even due to a small impact. Hence, since a packing material for absorbing an impact has to be sufficiently used, a size of a packing box may be increased and a packing cost and a distribution cost may be increased.

The development cartridge 10-1 of the present example is distributed in a state where the developer is not filled in the development cartridge 10-1. When the printer is purchased and the development cartridge 10-1 is first inserted into the printer, or when the development cartridge 10-1 is used up and thus the development cartridge 10-1 is removed from the printer and a new development cartridge 10-1 is inserted into the printer, the developer is filled in the new development cartridge 10-1 and then the development cartridge 10-1 is inserted into the printer.

Various structures for filling the developer in the development cartridge 10-1 may be considered. For example, the developer housing 110 may include a main housing 110-1 and a cover 110-2. A structure where the cover 110-2 is separated from the main housing 110-1 to open one entire surface of the main housing 110-1, the developer is filled in the main housing 110-1, and then the cover 110-2 is coupled to the main housing 110-1 may be considered. In this structure, the developer may be scattered and may contaminate a periphery of the main housing 110-1 when the developer is filled into the main housing 110-1. Also, a foreign material may be introduced along with the developer into the main housing 110-1. When the foreign material is stuck between the regulating member 16 and the developing roller 13, an image defect such as white lines may occur in a sub-scan direction on a printed image.

Figure 4:
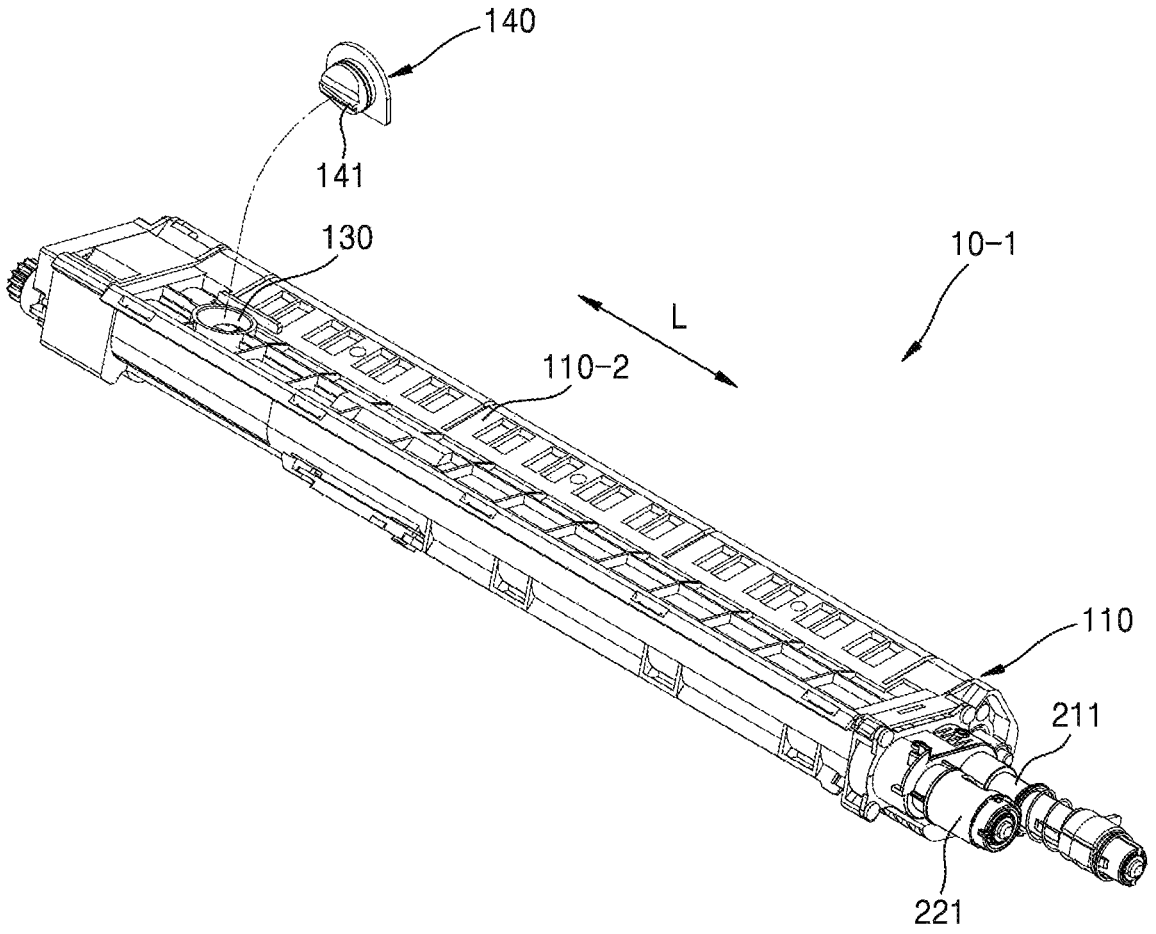
FIG. 4 is a perspective view of the development cartridge according to an example.

The development cartridge 10-1 of the present example has a structure for minimizing the area of an opening that is open to fill the developer. FIG. 4 is a perspective view of the development cartridge 10-1 according to an example. Referring to FIG. 4, in order to inject a developer, a developer inlet 130 is provided in the developer housing 110, e.g., the cover 110-2. A cap 140 is used to close the developer inlet 130. The cap 140 may be tightly inserted into the developer inlet 130. The cap 140 may be separated from the developer inlet 130 to open the developer inlet 130, and the developer may be filled in the developer housing 110. After the developer is completely injected, the cap 140 may be inserted into the developer inlet 130 to close the developer inlet 130.

Figure 5:
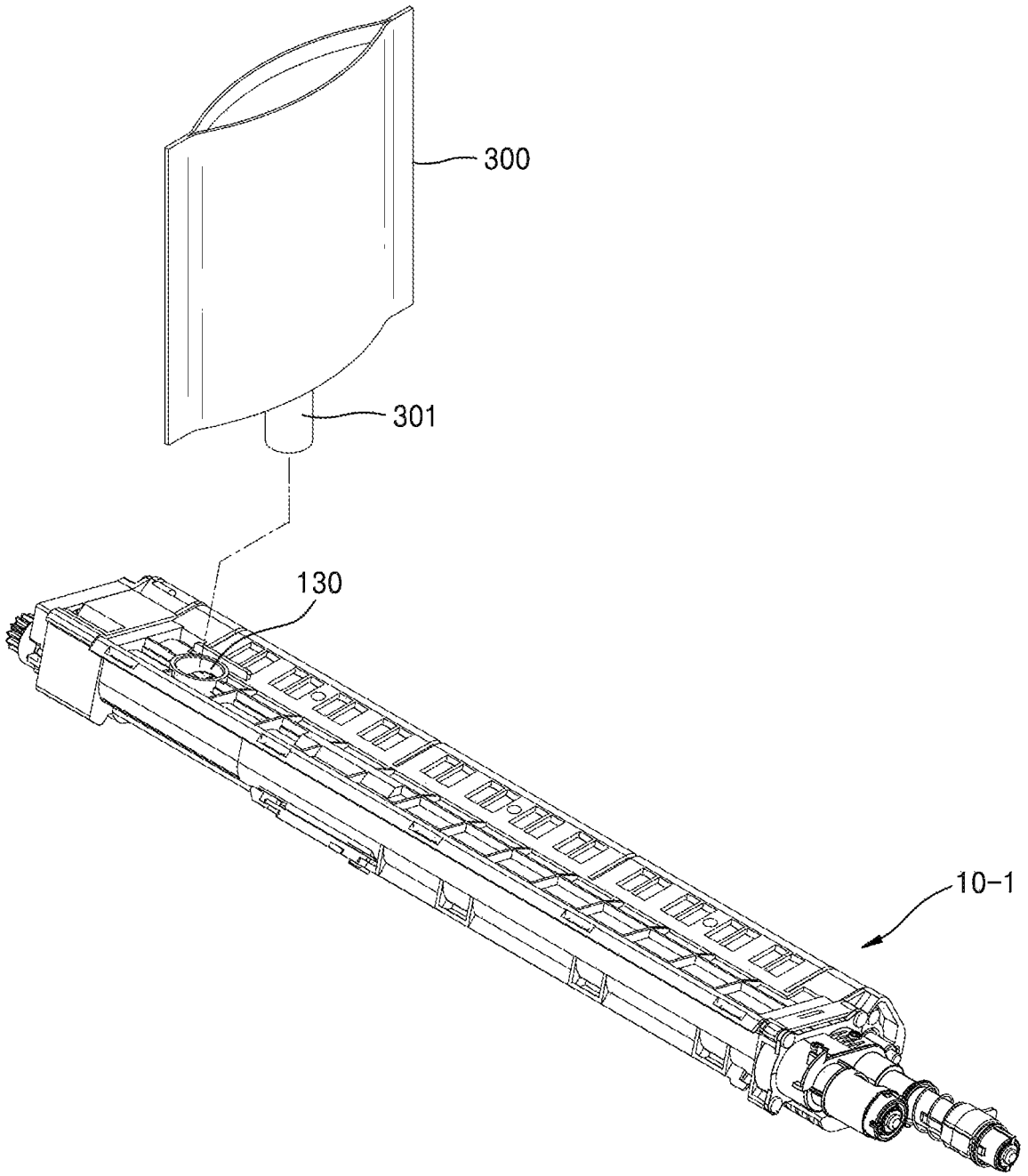
FIG. 5 is a perspective view illustrating an example where a developer is injected into the development cartridge.

FIG. 5 is a perspective view illustrating an example where a developer is injected into the development cartridge 10-1. Referring to FIG. 5, a developer may be provided in a state where the developer is sealed in a pouch 300 having an outlet 301. The outlet 301 is closed with a lid (not shown). A size of the developer inlet 130 may be slightly greater than a size of the outlet 301 so that the outlet 301 is inserted into the developer inlet 130. After the lid is removed, the outlet 301 may be inserted into the developer inlet 130 and the developer may be filled in the development cartridge 10-1. After the filling is completed, the cap 140 may be coupled to the developer inlet 130 to close the developer inlet 130. In this structure, scattering of the developer during a process of injecting the developer may be reduced. Also, the risk of introducing a foreign material through the developer inlet 130 may be reduced.

Assuming that the developer is excessively injected into the developing chamber 210 or the agitating chamber 220, an initial driving load applied to a driving motor (not shown) may be increased when driving starts after the development cartridge 10-1 is inserted into a printer. In this regard, a position of the developer inlet 130 may be determined so that the developer injected into the developer housing 110 through the developer inlet 130 is uniformly injected into the developing chamber 210 and the agitating chamber 220.

Figure 6:
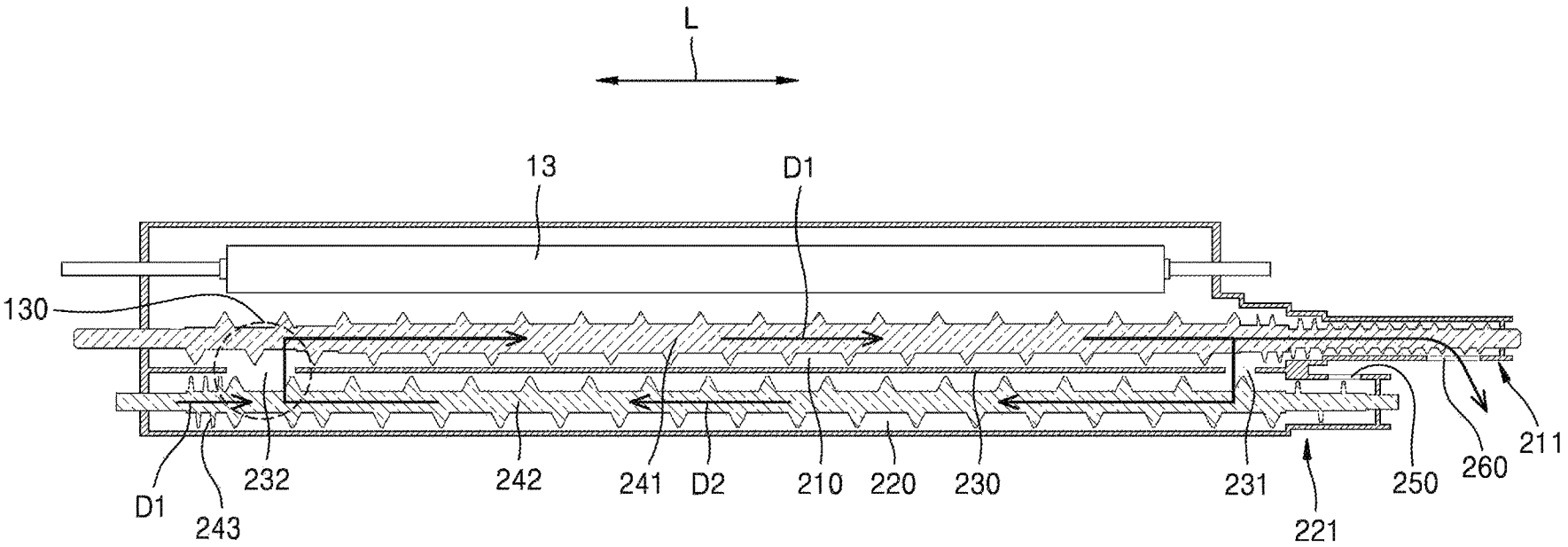
FIG. 6 is a view illustrating a position of a developer inlet according to an example.

FIG. 6 is a view illustrating a position of the developer inlet 130 according to an example. Referring to FIG. 6, the developer inlet 130 may be formed over the developing chamber 210 and the agitating chamber 220. In this structure, a developer introduced to the developer inlet 130 may naturally flow into the developing chamber 210 and the agitating chamber 220.

The developer inlet 130 may be located at an appropriate position in the longitudinal direction L. For example, when the developer inlet 130 is located at a central portion in the longitudinal direction L, the developer may be uniformly injected into the developing chamber 210 and the agitating chamber 220 in the longitudinal direction L by alternately tilting the development cartridge 10-1 in the longitudinal direction L while injecting the developer. For example, when the developer inlet 130 is located at an end portion in the longitudinal direction L, the developer may be uniformly injected into the developing chamber 210 and the agitating chamber 220 in the longitudinal direction L by raising a portion of the development cartridge 10-1 close the developer inlet 130 by, e.g., about 45°, while injecting the developer.

The developer inlet 130 may be located at a position corresponding to one of the first and second communication holes 231 and 232. In this structure, when the developer is injected into the developer housing 110 through the developer inlet 130, the flow of the developer is not blocked by the partition wall 230, and thus the developer may be uniformly injected into the developing chamber 210 and the agitating chamber 220.

In the development cartridge 10-1 having a structure where the developer outlet 260 is formed at an end portion in the longitudinal direction L, when the developer inlet 130 is located close to the developer outlet 260, the developer that is fresh at the beginning of driving may be discharged to the developer outlet 260, thereby leading to a waste. In this regard, the developer inlet 130 may be located at a position opposite to that of the developer outlet 260 in the longitudinal direction L. For example, when the developer outlet 260 is located close to the first communication hole 231 as shown in FIG. 6, the developer inlet 130 may be located close to the second communication hole 232 that is opposite to the first communication hole 231 in the longitudinal direction L. In a structure where the developer inlet 130 is located at a position corresponding to one of the first and second communication holes 231 and 232, the developer inlet 130 may be located at a position corresponding to a communication hole, e.g., the second communication hole 232, that is opposite to the developer outlet 260.

It is necessary to maintain the developer in the developing chamber 210 at an appropriate level. A level of the developer in the developing chamber 210 may be determined by the amount of circulation of the developer. The amount of circulation of the developer may be determined by shapes, transportation abilities, and rotational speeds of the first and second conveying members 241 and 242. In order to change the amount of circulation of the developer, shapes or rotational speeds of the first and second conveying members 241 and 242 may be changed. In order to change shapes of the first and second conveying members 241 and 242, the first and second conveying members 241 and 242 have to be replaced. In order to change rotational speeds of the first and second conveying members 241 and 242, a dedicated motor for driving the first and second conveying members 241 and 242 has to be employed and the number of rotations of the dedicated motor has to be changed or a transmission ratio of a power transmission unit transmitted to the first and second conveying members 241 and 242 has to be changed. Accordingly, it is not easy to change the amount of circulation of the developer by changing shapes or rotational speeds of the first and second conveying members 241 and 242. Furthermore, the amount of circulation of the developer is affected by a fluidity of the developer according to an environment in which the printer is used. It is not easy to change shapes of the first and second conveying members 241 and 242 or change rotational speeds of the first and second conveying members 241 and 242 according to an environment in which the printer is used.

In the present example, a method of adjusting the amount of circulation of the developer by changing the area of an opening of a communication hole, e.g., the second communication hole 232, corresponding to the developer inlet 130, is used. The area of the opening of the second communication hole 232 is changed by using the cap 140.

Referring to FIG. 4, a protrusion 141 protruding into a communication hole, extending in the longitudinal direction L, and configured to limit (adjust) the area of the opening of the communication hole may be provided on the cap 140. For example, when the developer inlet 130 is located at a position corresponding to the second communication hole 232, the protrusion 141 protrudes into the second communication hole 232 and extends in the longitudinal direction L. The area of the opening of the second communication hole 232 is changed according to the protrusion amount of the protrusion 141, and the change in the area of the opening of the second communication hole 232 affects the amount of the developer passing through the second communication hole 232. When the protrusion amount of the protrusion 141 is changed, the amount of the developer circulating in the developer housing 110 may be changed.

Figure 7:
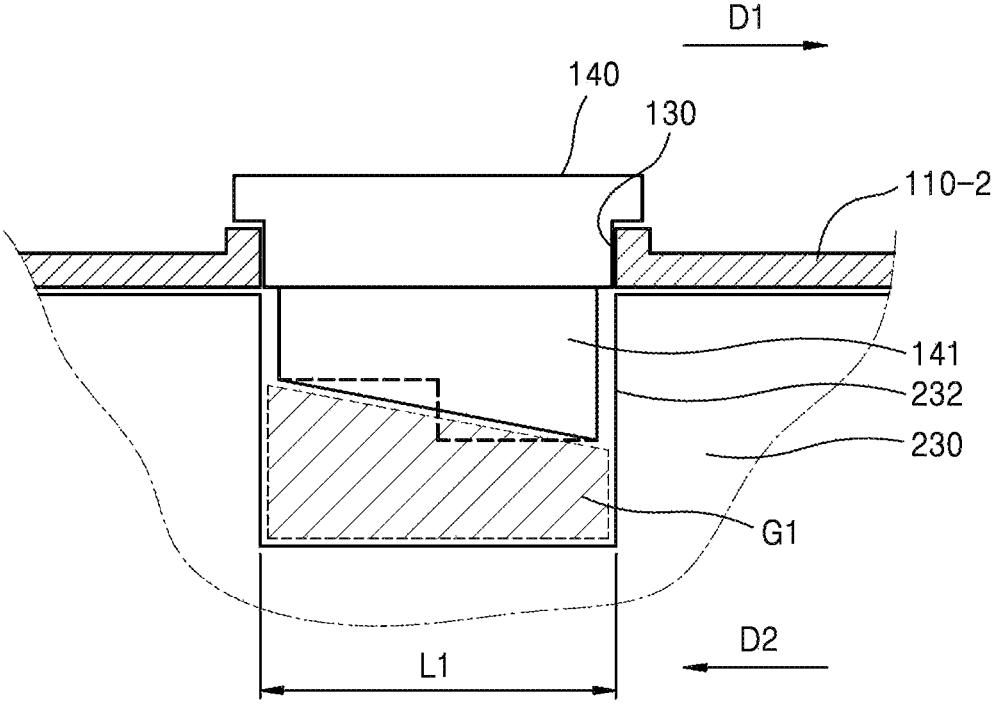
FIGS. 7 and 8 are views illustrating a change in an area of an opening of a second communication hole according to the protrusion amount of a protrusion.
Figure 8:
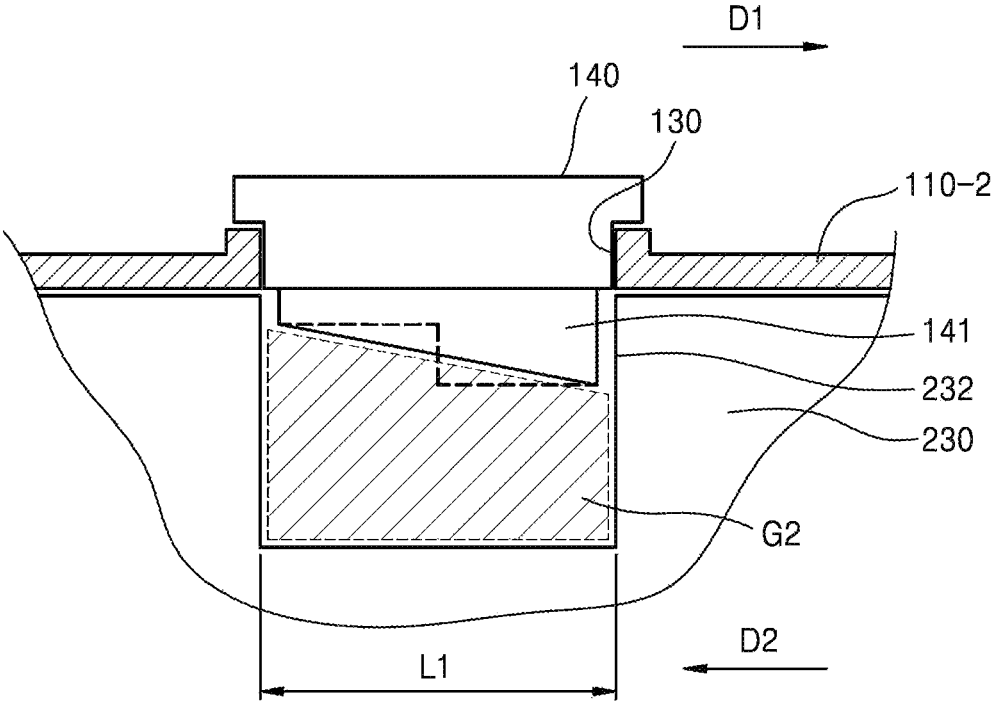

FIGS. 7 and 8 are views illustrating a change in the area of an opening of the second communication hole 232 according to the protrusion amount of the protrusion 141. For example, when the protrusion amount of the protrusion 141 increases as shown in FIG. 7, the area G1 of the opening of the second communication hole 232 decreases and pressure applied to a developer around the second communication hole 232 increases. Accordingly, a large amount of developer may pass through the second communication hole 232 and may move from the agitating chamber 220 to the developing chamber 210, thereby increasing the amount of circulation of the developer. As the area G1 of the opening decreases, the amount of the developer passing through the second communication hole 232 may increase. However, when the area G1 of the opening is less than a threshold area, the amount of the developer passing through the second communication hole 232 may decrease. Accordingly, the protrusion amount of the protrusion 141 is determined so that the area G1 of the opening is not less than the threshold area.

In contrast, when the protrusion amount of the protrusion 141 decreases, the area G2 of the opening of the second communication hole 232 increases and pressure applied to the developer around the second communication hole 232 decreases. Accordingly, the amount of the developer passing through the second communication hole 232 and moving from the agitating chamber 220 to the developing chamber 210 decreases and the amount of circulation of the developer decreases. The amount of circulation of the developer in the developer housing 110 may be maintained at an appropriate level by coupling the cap 140 including the protrusion 141 having an appropriate protrusion amount to the developer inlet 130.

A fluidity of the developer is affected by an environment in which a printer is used. A fluidity of the developer in a high temperature and high humidity environment may decrease and a level of the developer in the developing chamber 210 may decrease to be lower than an appropriate level. In this case, as shown in FIG. 7, the developer in the developing chamber 210 may be maintained at a stable level by increasing the amount of circulation of the developer by coupling the cap 140 including the protrusion 141 having a large protrusion amount to the developer inlet 130.

In contrast, in a low temperature and low humidity environment, a fluidity of the developer may increase and a level of the developer of the developing chamber 210 may excessively increase. When a trickle development method is used, the developer may be excessively discharged through the developer outlet 260, thereby leading to a waste of the developer and an image defect such as diagonal stripes on a printed image. As shown in FIG. 8, the developer in the developing chamber 210 may be maintained at a stable level by reducing the amount of circulation of the developer by coupling the cap 140 including the protrusion 141 having a small protrusion amount to the developer inlet 130.

As such, since the developer of the developing chamber 210 may be easily maintained at an appropriate level by providing the cap 140 including the protrusion 141 having an appropriate protrusion amount according to an environment in which the printer is used, a printed image having stable quality may be obtained. That is, when an environment in which the printer is used is changed, the developer of the developing chamber 210 may be maintained at an appropriate level in accordance with the changed environment by replacing only the cap 140.

The protrusion amount of the protrusion 141 may vary according to an arrangement of the developing chamber 210 and the agitating chamber 220. For example, as shown in FIG. 3, in a structure where the agitating chamber 220 is located under the developing chamber 210 in the direction of gravity, the developer has to move in a direction opposite to the direction of gravity through the second communication hole 232. In this structure, appropriate pressure may be applied to the developer around the second communication hole 232 by providing the cap 140 including the protrusion 141 having an appropriate protrusion amount. For example, when the protrusion amount of the protrusion 141 decreases, the amount of the opening increases and pressure applied to the developer around the second communication hole 232 decreases. Accordingly, the amount of the developer moving in the direction opposite to the direction of gravity decreases due to the pressure applied to the developer. Also, the amount of the developer dropped into the agitating chamber 220 again from among the developer moving in the direction opposite to the direction of gravity increases. When the protrusion amount of the protrusion 141 increases, the area of the opening decreases and pressure applied to the developer around the second communication hole 232 increases. Accordingly, the amount of the developer moving in the direction opposite to the direction of gravity increases due to the pressure applied to the developer, and the amount of the developer dropped into the agitating chamber 220 from the developing chamber 210 decreases. In this regard, the developer may stably pass through the second communication hole 232 in the direction opposite to the direction of gravity and may move from the agitating chamber 220 to the developing chamber 210 by providing the cap 140 including the protrusion 141 having an appropriate protrusion amount.

The protrusion amount of the protrusion 141 may not be constant in the longitudinal direction L. For example, as marked by dashed lines of FIGS. 7 and 8, the protrusion amount of the protrusion 141 close to a corresponding communication hole (e.g., the second communication hole 232) from among the first and second communication holes 231 and 232 may be less than that close to another communication hole (e.g., the first communication hole 231). The developer transported to the developing chamber 210 through the second communication hole 232 is transported by the first conveying member 241 to the first communication hole 231, that is, in the first direction D1. When the protrusion amount of the protrusion 141 close to the second communication hole 232 is less than that close to the first communication hole 231, the developer passing through a longitudinal portion L1 of the second communication hole 232 is biased in the first direction D1. Accordingly, the developer supplied to the developing chamber 210 may be easily transported in the first direction D1 by the first conveying member 241.

The protrusion 141 may be inclined in the longitudinal direction L. For example, as marked by solid lines of FIGS. 7 and 8, the protrusion amount of the protrusion 141 may increase away from a corresponding communication hole (e.g., the second communication hole 232) toward another communication hole (e.g., the first communication hole 231) from among the first and second communication holes 231 and 232.

Figure 9:
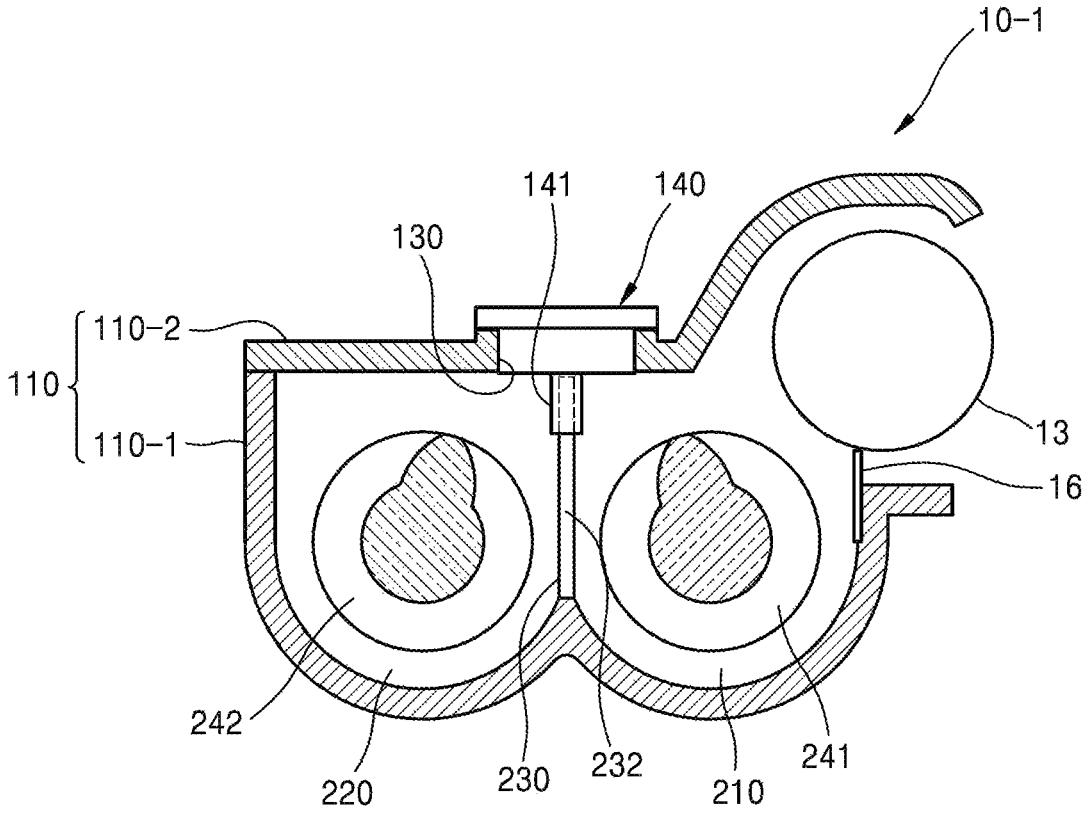
FIG. 9 is a cross-sectional view of the development cartridge according to an example.

FIG. 9 is a cross-sectional view of the development cartridge 10-1 according to an example. In the development cartridge 10-1 of the present example, the developing chamber 210 and the agitating chamber 220 are horizontally parallel. A developer horizontally moves through a communication hole, e.g., the second communication hole 232, corresponding to the developer inlet 130 and moves from the agitating chamber 220 to the developing chamber 210. Even in the development cartridge 10-1 having this structure, the developer of the developing chamber 210 may be maintained at an appropriate level by adjusting the amount of the developer moving from the agitating chamber 220 to the developing chamber 210 by controlling the protrusion amount of the protrusion 141 provided on the cap 140.

As described above, since the protrusion amount of the protrusion 141 is not constant in the longitudinal direction L, the cap 140 has to be coupled to the developer inlet 130 so that the protrusion 141 is inserted into a corresponding communication hole, e.g., the second communication hole 232 in a right direction. If the cap 140 is reversely inserted, an error may occur in the amount of circulation of the developer and an image defect may occur on a printed image. The development cartridge 10-1 may include a position determiner for determining a coupling position of the cap 140 to the developer inlet 130 so that the protrusion 141 is aligned in the longitudinal direction L. The position determiner may include a first position determiner provided on the cap 140, and a second position determiner provided on the developer housing 110 to have a shape complementary to that of the first position determiner and engaged with the first position determiner.

Figure 10:
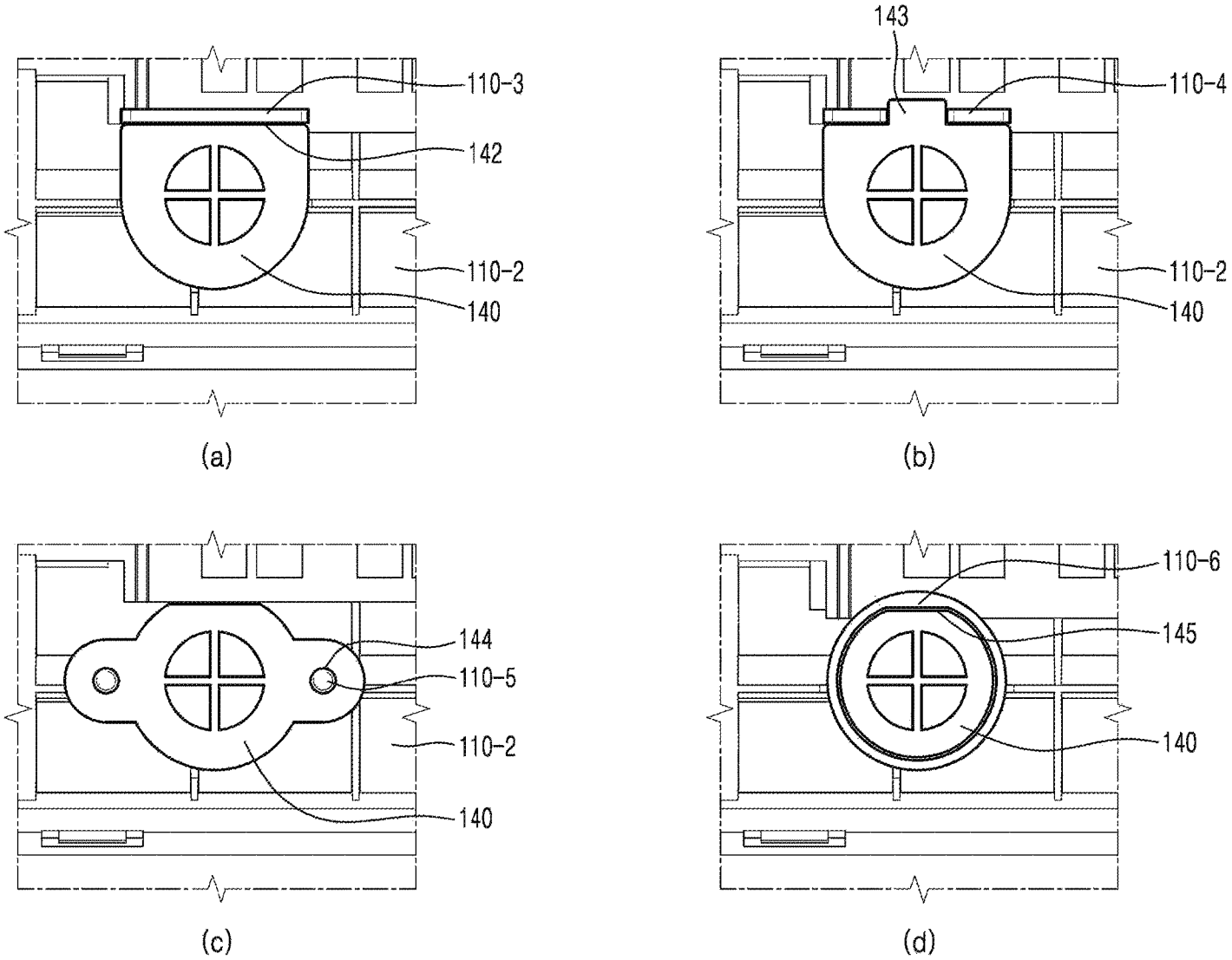
FIGS. 10A through 10D are views illustrating position determiners according to examples.

FIGS. 10A through 10D illustrate position determiners according to examples. Referring to FIG. 10A, a first position determiner may include a linear portion 142 provided on the cap 140, and a second position determiner may include a linear guide portion 110-3 provided in the developer housing 110, e.g., the cover 110-2 so that the linear portion 142 is aligned with the linear portion 142. In this structure, the cap 140 may be inserted into the developer inlet 130 only in a state where the linear portion 142 and the linear guide portion 110-3 are aligned with each other. Accordingly, the protrusion 141 may be inserted into the second communication hole 232 in an appropriate direction.

Referring to FIG. 10B, a first position determiner may include a protruding portion 143 provided on the cap 140, and a second position determiner may include a groove portion 110-4 provided in the developer housing 110, e.g., the cover 110-2 so that the protruding portion 143 is inserted into the protruding portion 143. Referring to FIG. 10C, a first position determiner may include an insertion hole 144 formed in the cap 140, and a second position determiner may include a boss 110-5 provided in the developer housing 110, e.g., the cover 110-2 to be inserted into the insertion hole 144. Referring to FIG. 10D, a first position determiner may include a head portion 145 having an asymmetric shape and provided on the cap 140, and a second position determiner may include a rib 110-6 provided in the developer housing 110, e.g., the cover 110-2 to surround an outer surface of the head portion 145. Each of position determiners may have any of various shapes.

While the present disclosure has been particularly shown and described with reference to examples thereof, they are provided for illustration and it will be understood by one of ordinary skill in the art that various modifications and equivalent other examples can be made from the present disclosure. Accordingly, the true technical scope of the present disclosure is defined by the technical spirit of the appended claims.

What is claimed is:

1. A development cartridge comprising:

a developing roller;

a developer housing to receive a developer, the developer housing comprising:

a developing chamber to have the developing roller in the developing chamber and extending in a longitudinal direction of the developing roller, an agitating chamber located parallel to the developing chamber, a partition wall to separate the developing chamber from the agitating chamber, the partition wall having a first communication hole and a second communication hole respectively formed at both end portions of the partition wall in the longitudinal direction, through which the developing chamber and the agitating chamber are to communicate through, and a developer inlet through which the developer is injectable into the developer housing, for the developer housing to receive the developer, the developer inlet formed in the developer housing at a position corresponding to the first communication hole or the second communication hole, the developer inlet closeable with a cap.

2. The development cartridge of claim 1, wherein a developer outlet through which a surplus developer in the developing chamber and the agitating chamber is discharged is formed in the developer housing, and the developer inlet is located at a position corresponding to, from among the first communication hole and the second communication hole, a communication hole that is opposite to the developer outlet.

3. The development cartridge of claim 1, further comprising:

a first conveying member to transport the developer in a first direction, the first conveying member provided in the developing chamber, and a second conveying member to transport the developer in a second direction opposite to the first direction, the second conveying member provided in the agitating chamber, wherein the developer is to be transported through the first communication hole from the developing chamber to the agitating chamber, and the developer is to be transported through the second communication hole from the agitating chamber to the developing chamber.

4. The development cartridge of claim 3, wherein the agitating chamber is located under the developing chamber in a direction of gravity, and the developer inlet is located at a position corresponding to the second communication hole.

5. The development cartridge of claim 1, wherein the cap has a protrusion protruding into a corresponding communication hole from among the first and second communication holes, extending in the longitudinal direction, and to limit an area of an opening of the corresponding communication hole.

6. The development cartridge of claim 5, wherein a protrusion amount of the protrusion is not constant along the longitudinal direction.

7. The development cartridge of claim 6, wherein the protrusion amount of the protrusion close to the corresponding communication hole is less than the protrusion amount close to another communication hole from among the first communication hole and second communication hole.

8. The development cartridge of claim 6, wherein the protrusion amount of the protrusion increases according to a distance farther away from the corresponding communication hole toward another communication hole from among the first and second communication holes.

9. The development cartridge of claim 6, comprising:

a position determiner to determine a coupling position of the cap to the developer inlet, so as to align the protrusion in the longitudinal direction.

10. A development cartridge comprising:

a developing roller;

a developer housing to receive a developer, the developer housing comprising a developing chamber to have the developing roller in the developing chamber and extending in a longitudinal direction of the developing roller, an agitating chamber located parallel to the developing chamber and located under the developing chamber in a direction of gravity, and a partition wall to separate the developing chamber from the agitating chamber, the partition wall having a first communication hole and a second communication hole respectively formed at both end portions of the partition wall in the longitudinal direction, through which the developing chamber and the agitating chamber are to communicate through;

a developer inlet through which the developer is injectable into the developer housing, for the developer housing to receive the developer, the developer inlet formed in the developer housing and along the developing chamber and the agitating chamber, the developer inlet closeable with a cap.

11. The development cartridge of claim 10, further comprising:

a first conveying member provided in the developing chamber, to transport the developer from the second communication hole to the first communication hole, a second conveying member provided in the agitating chamber, to transport the developer from the first communication hole to the second communication hole, and a developer outlet through which a surplus developer is discharged, the developer outlet provided at an end portion of the developing chamber close to the first communication hole.

12. The development cartridge of claim 11, wherein the developer inlet is located at a position corresponding to the second communication hole.

13. The development cartridge of claim 12, wherein the cap has a protrusion protruding into the second communication hole, extending in the longitudinal direction, and to limit an area of an opening of the second communication hole.

14. The development cartridge of claim 13, wherein a protrusion amount of the protrusion close to the second communication hole is less than that close to the first communication hole.

15. The development cartridge of claim 13, wherein a protrusion amount of the protrusion increases according to a distance farther away from the second communication hole toward the first communication hole.

* * * * *